US012227276B1

(12) United States Patent
Cavallaro et al.

(10) Patent No.: US 12,227,276 B1
(45) Date of Patent: Feb. 18, 2025

(54) INFLATABLE AND DEPLOYABLE MAST FAIRINGS FOR SUBMARINE SAIL SYSTEMS

(71) Applicant: The United States of America as represented by the Secretary of the Navy, Newport, RI (US)

(72) Inventors: Paul V Cavallaro, Raynham, MA (US); Nicholas A Valm, Dartmouth, MA (US); Jacob D O'Donnell, Middletown, RI (US); Michael P Smith, Warwick, RI (US)

(73) Assignee: The United States of America as represented by the Secretary of the Navy

( * ) Notice: Subject to any disclaimer, the term of this patent is extended or adjusted under 35 U.S.C. 154(b) by 517 days.

(21) Appl. No.: 17/840,660

(22) Filed: Jun. 15, 2022

(51) Int. Cl.
*B63G 8/06* (2006.01)
*B63G 8/38* (2006.01)

(52) U.S. Cl.
CPC ..... *B63G 8/06* (2013.01); *B63G 8/38* (2013.01); *B63B 2203/00* (2013.01)

(58) Field of Classification Search
CPC ..... B63G 8/06; B63G 8/38; B63B 2203/00
See application file for complete search history.

(56) References Cited

U.S. PATENT DOCUMENTS

2008/0087762 A1* 4/2008 Holloman ..... B64U 10/30 244/30

* cited by examiner

*Primary Examiner* — S. Joseph Morano
*Assistant Examiner* — Jovon E Hayes
(74) *Attorney, Agent, or Firm* — James M. Kasischke; Michael P. Stanley; Jeffry C. Severson

(57) ABSTRACT

An inflatable deployable mast fairing assembly is provided with a rigid foundation, a hydrodynamic fairing and at least one soft actuator. The hydrodynamic fairing is shaped to close an aperture formed between a deployable hardware system and a sail bay opening. A first soft actuator connects to the rigid foundation at one end and to the hydrodynamic fairing at another. Fluid pressurization elongates a first soft actuator coaxial to the deployable hardware system to fittedly position the fairing in the aperture with a void in the fairing to receive the hardware system. If the rigid foundation is sail-mounted, a second soft actuator connects to the sail-mounted foundation opposite the first soft actuator and to a counter flange mechanically connected to the hydrodynamic fairing. A second pressurization elongates the second soft actuator coaxial to the deployable hardware system to retract the hydrodynamic fairing from the aperture.

10 Claims, 8 Drawing Sheets

INFLATABLE AND DEPLOYABLE MAST FAIRINGS FOR SUBMARINE SAIL SYSTEMS

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER APPLICATIONS

None.

BACKGROUND OF THE INVENTION

(1) Field of the Invention

The present invention relates generally to inflatable soft structures and more particularly to deployable and stowable submarine sail structures.

(2) Description of the Related Art

Current submarine sails are structural platforms that host various systems and equipment including periscopes; communication antenna masts; acoustic, electromagnetic, and radar sensor systems; exhaust ports and crew escape trunks. Typical sail structures have multiple equipment bays that house the systems when not in use.

As illustrated in the prior art sail system 100 of FIG. 1; such hardware systems include mast structures that support radar 110, photonics 112, multi-function communications 114, high data rate communications 116, electronic warfare components 118 and snorkels 120. When operational, the mast structures protrude from atop a host sail 122. When non-operational, the mast structures are retracted and stowed within the equipment bays of the host sail 122.

As depicted in FIG. 2 for a sail system schematic 200, the bays positioned along a sail cap 202 of the host sail 122 are commonly covered by doors 212, 216, 218 and hatches 210, 214, 220. Each door and hatch is shaped to cover a respective bay. These sail bay covers restore continuity of the faired sail surface along the sail cap 202. When operational, the sail bay covers retract or rotatably open with the latter illustrated by the states of the doors 212, 216, 218 to allow the stowed masts to deploy from the sail cap 202.

In known submarine sail designs, temporary apertures are created when the sail bay covers open during mast operations. In the likely event that a deployed hardware system does not present a trunk having a cross-section sized or shaped similar to the sail bay cover to fully close off the opening from which that hardware system is deployed during operation; the result is a temporary aperture at the opened bay door.

This aperture can generate flow disturbances that produce vortex shedding, turbulence, and flow induced noise (fluid-structure interactions and vibrations). Such disturbances negatively impact the hydrodynamic performance of onboard equipment during submerged operations.

The current state of inflatable soft structures technologies provides unique solutions to numerous challenges limiting operations, capabilities, and system designs. Inflatable soft structures have been successfully developed for inflatable control surfaces, deployable energy absorbers and n-demand structures.

Successful design and performance of soft inflatable structures are attributable to technological advancements derived from: high performance fibers; novel fabric architectures and three-dimensional woven preforms capable of unique mechanical behaviors as well as continuous weaving processes for the elimination of seams in inflatable structures.

Technological advancements also include robust physics-based modeling methods with fluid-structure interaction capabilities including finite element analysis; fluid dynamics; and material test methods for characterization of multi-axial and pressure-dependent mechanical behaviors for inputs to numerical models.

As shown in U.S. Pat. No. 8,273,427; the stiffness, strength, and damage tolerance of inflatable components is enhanced by attaching high strength fiber layers embedded in a thermoplastic matrix. The fiber-reinforced thermoplastic layers, referred to as soft composites, are generally anisotropic and align in a unidirectional or multi-directional orientation to retain minimal bending stiffness but appreciable in-plane stiffness.

When attached to inflated three-dimensional structures, the soft composites produce four-fold or higher increases in bending stiffness of the three-dimensional structure due to the increase in a second area moment of inertia in accordance with the Parallel Axis Theorem, but when deflated permits the inflatable structure to collapse and be compacted. The patent discloses reinforcements for air inflated drop stitch panels and inflatable fabric cylinders.

Also, structural and dynamic performance of the inflatable fabric components can be further optimized in accordance with the crimp-imbalanced woven architectures described by U.S. Pat. Nos. 8,877,109; 8,701,255; 8,689,414; and 8,555,472 to Cavallaro incorporated herein by reference. Dynamic energy absorption capacities and ballistic impact resistance increase with increasing crimp imbalance among the warp and weft fabric directions.

Based on the extensive use of soft fabrics in structural components, a continuing need exists for on-demand deployable and compactable solutions to challenges in employing inflatable soft structures technology in the design of submarine sail structures.

BRIEF SUMMARY OF THE INVENTION

Accordingly, it is a primary object and general purpose of the present invention to provide an inflatable and deployable mast fairing assembly for closing an aperture formed between a deployable hardware system and a bay opening.

The assembly includes a rigid foundation, a hydrodynamic fairing and at least one soft actuator. The fairing has a perimeter which is shape-fitted to a contour of the aperture and also a central aperture as a pass-through for a portion of the deployable hardware system. A first soft actuator made of a bladdered membrane mounts at one end to the rigid foundation and at the other end to the hydrodynamic fairing. When pressurized with fluid, the first soft actuator coaxially elongates to fittedly position the hydrodynamic fairing in the aperture at the bay opening.

The rigid foundation can be either mast-mounted or sail-mounted. For a sail-mount, a counter flange is positioned opposite to a first plane of the rigid sail-mounted foundation. A first soft actuator is positioned on a second plane of the sail-mounted foundation and is mechanically attached to the hydrodynamic fairing. A second soft actuator is mechanically mounted at the first plane of the sail-mounted foundation and to the counter flange with the second soft actuator between the sail-mounted foundation and the counter flange.

Upon introduction of pressurized fluid, the second soft actuator elongates to be coaxial to the hardware system in order to retract the hydrodynamic fairing from the aperture. The first soft actuator, sail-mounted foundation, second soft actuator, and counter flange each include a void positioned coaxial with the aperture in the hydrodynamic fairing to define a central inner core which can receive the deployable hardware system.

Inflatable materials for constructing the soft actuators include vertically stacked cylindrical arches secured with webbing straps. The cylindrical arches include a circular woven fabric having internal bladders for fluid retention. A manifold supplies fluid pressurization to the soft actuators and, if so equipped, to an inflatable chamber in the hydrodynamic fairing.

The inflatable deployable mast fairing assembly may be retrofitted to a submarine sail system and, more specifically, to a bay that can internally stow the deployable hardware system.

These and other objects, features, and advantages of the present invention will become more readily apparent from the attached drawings and the detailed description of the invention.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein like reference numerals and symbols designate identical or corresponding parts throughout the several views and wherein.

DETAILED DESCRIPTION OF THE INVENTION

Embodiments of an inflatable deployable mast fairing include a generally soft or soft/rigid hybrid inflatable structure characterized by a geometry that conforms to and closes a temporary sail aperture. The aperture is formed when a hardware system such as an antenna or periscope mast deploys from a submarine sail system.

Inflatable structures internally pressurized with water above ambient depth pressure provide a soft actuation of equipment fairing. These fairings reduce flow noise, prevent external flow streams from entering the sail bays where flow recirculation can develop and stabilize the localized hydrodynamic flow fields near the sail cap.

Figure 5:
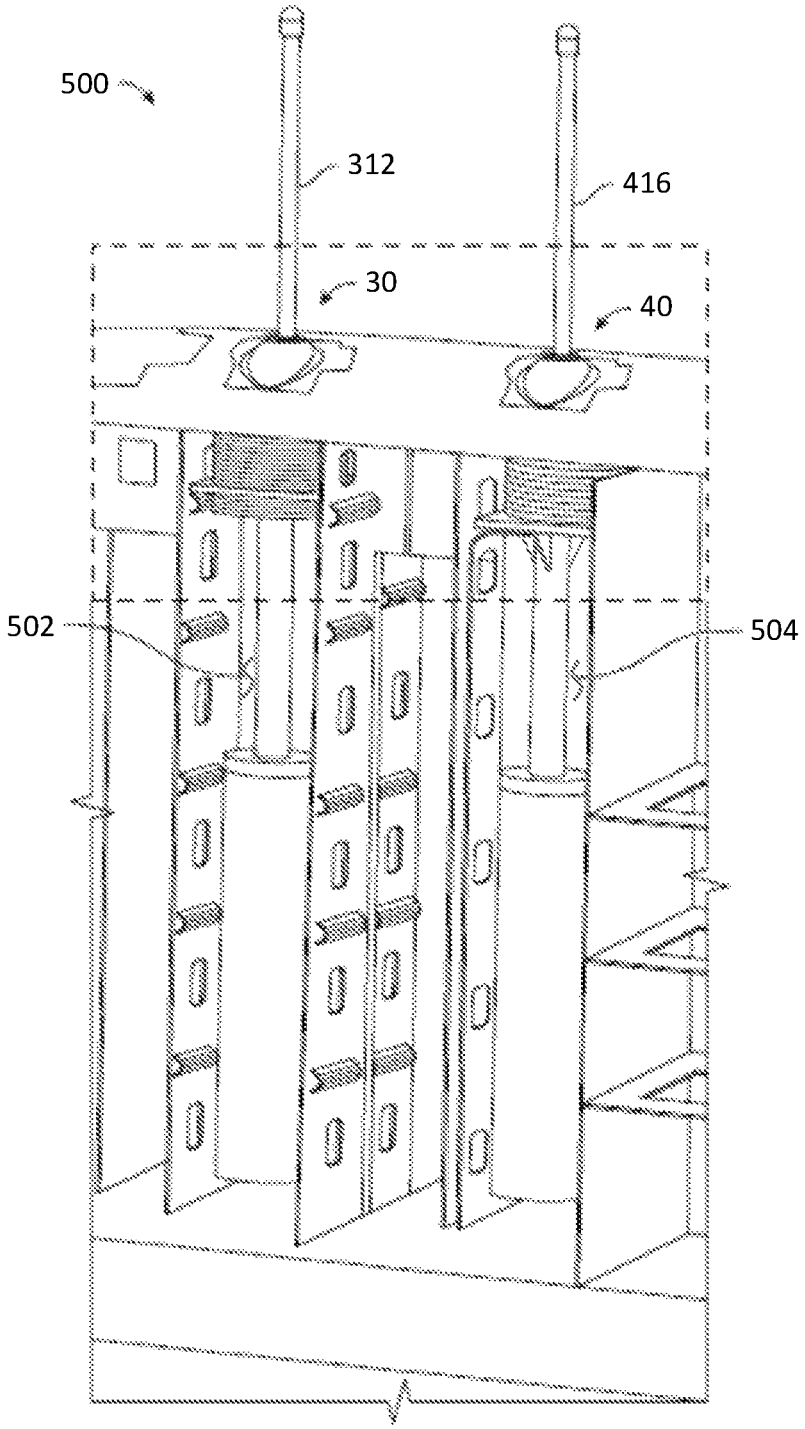
FIG. 5 depicts a perspective view of the sail-mounted inflatable deployable mast fairing assembly of FIG. 3 and the mast-mounted inflatable deployable mast fairing assembly of FIG. 4 with each in a deployed state within a cutaway of an exemplary sail system.
Figure 6:
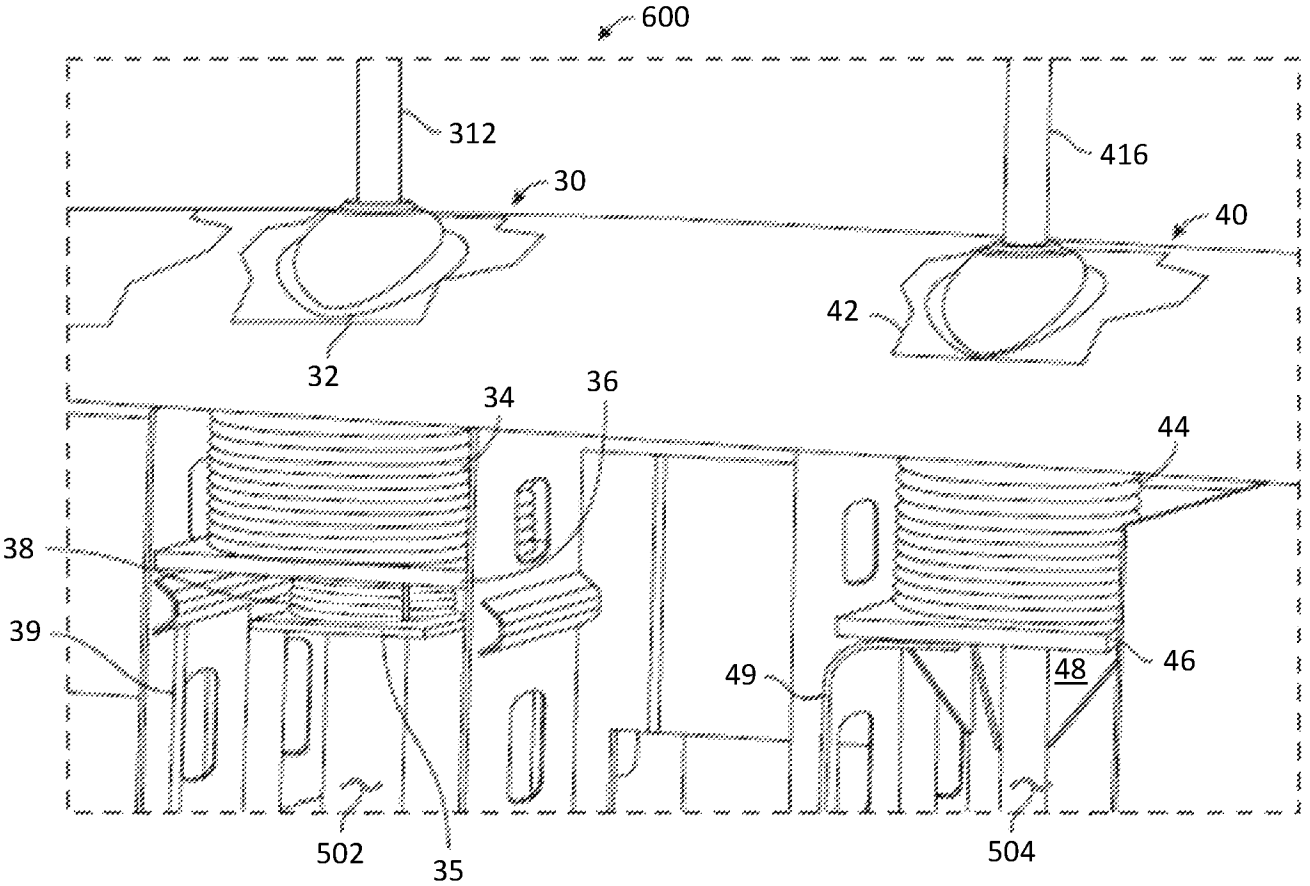
FIG. 6 depicts a cutaway view of the sail-mounted inflatable deployable mast fairing assembly of FIG. 3 and the mast-mounted inflatable deployable mast fairing assembly of FIG. 4 within the cutaway view of FIG. 5.
Figure 7:
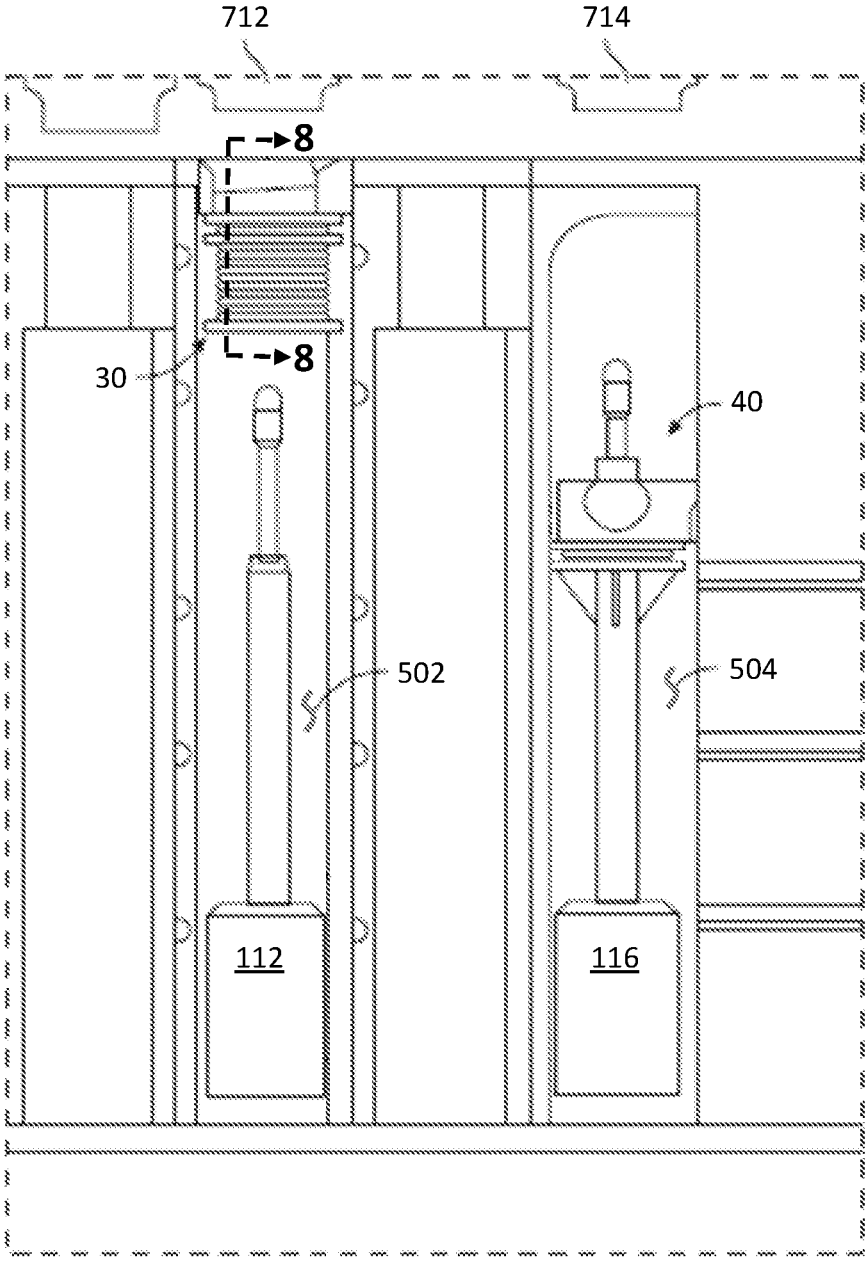
FIG. 7 depicts another cutaway view of the sail-mounted inflatable deployable mast fairing assembly of FIG. 3 and the mast-mounted inflatable deployable mast fairing assembly of FIG. 4 with each in a respective stowed state.

FIGS. 3-8 illustrate embodiments of an inflatable deployable mast fairing or IDMF (FIG. 3 and FIG. 4) with each shown in a deployed configuration (FIG. 5 and FIG. 6) and in a stowed configuration (FIG. 7). The mast fairing assembly is characterized by fairing forms, foundation mounting options and soft inflatable actuator configurations.

Figure 1:
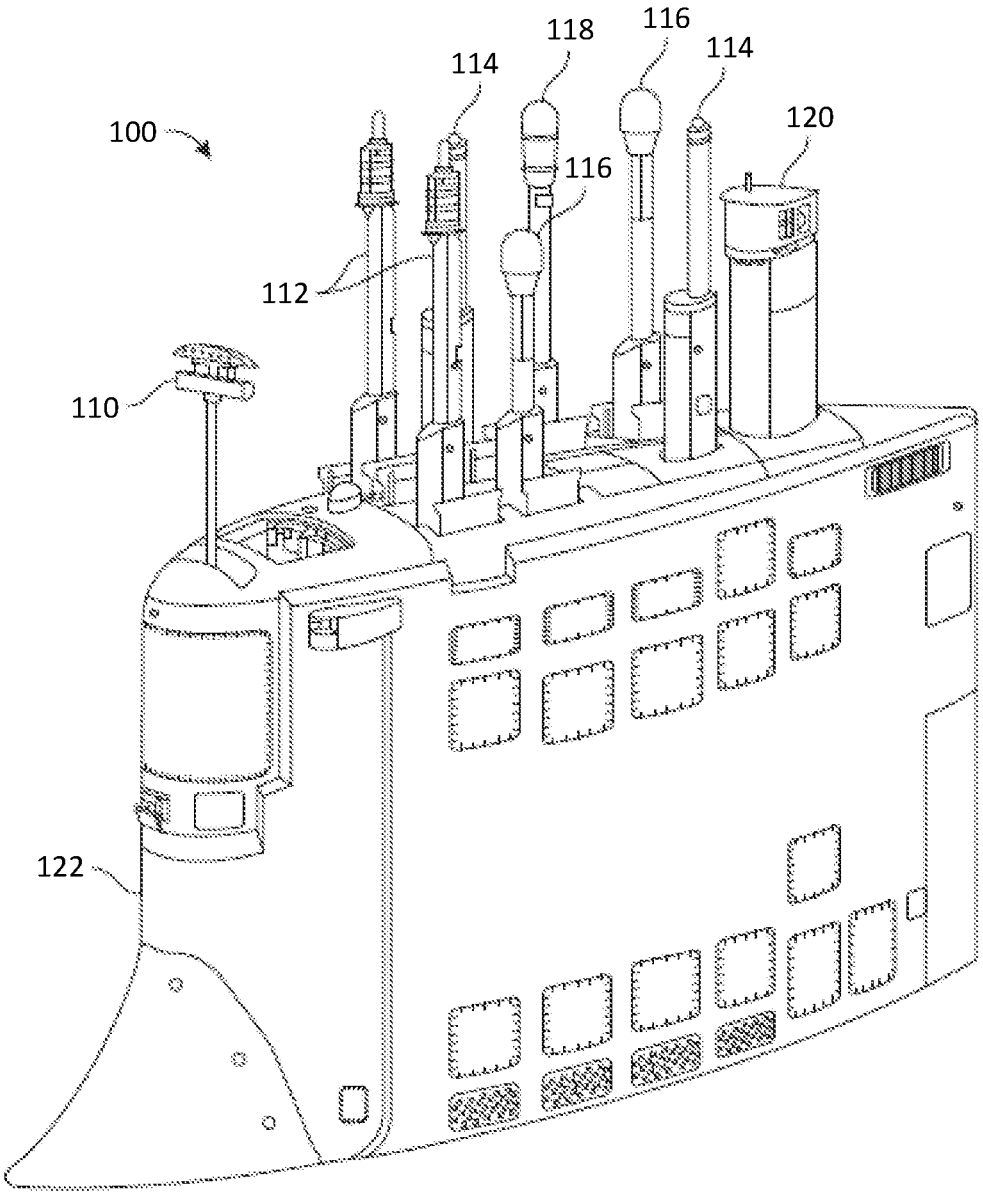
FIG. 1 (PRIOR ART)
FIG. 1 depicts a top perspective view of a prior art submarine sail with deployed hardware structures.
Figure 2:
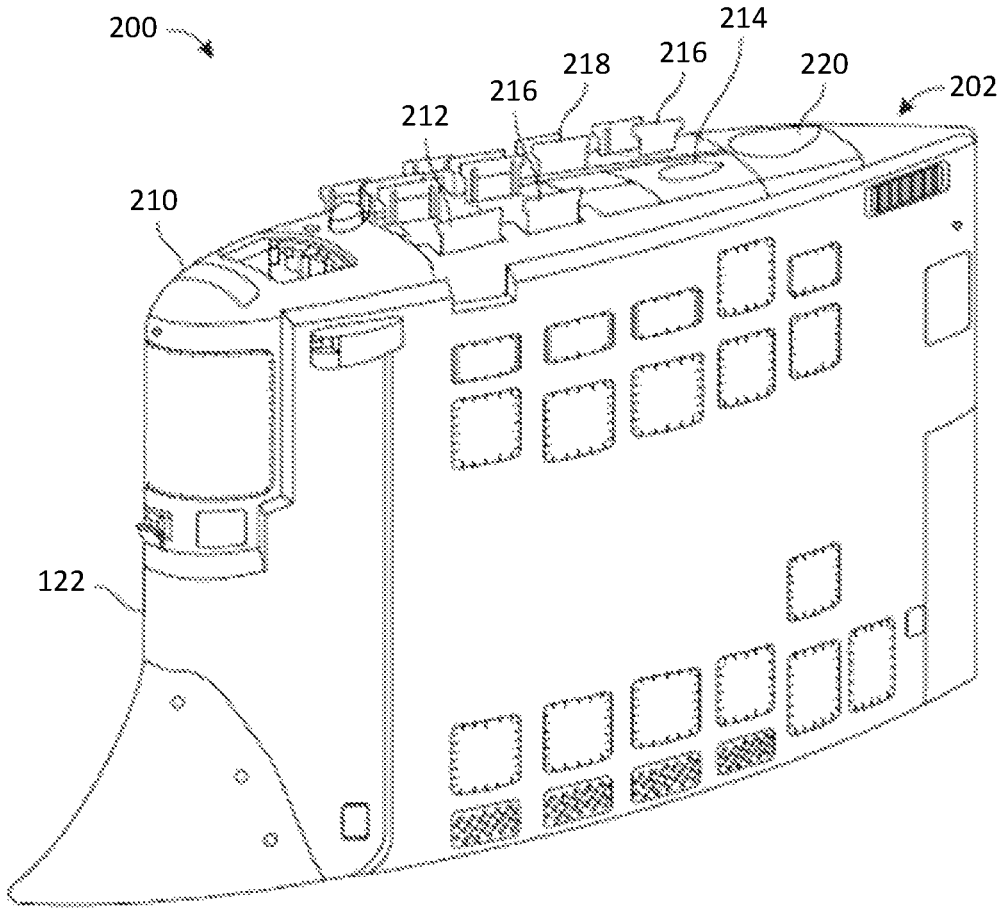
FIG. 2 (PRIOR ART)
FIG. 2 depicts a top perspective view of the prior art submarine sail of FIG. 1 with stowed hardware structures and hatches and doors shown in open positions.
Figure 3:
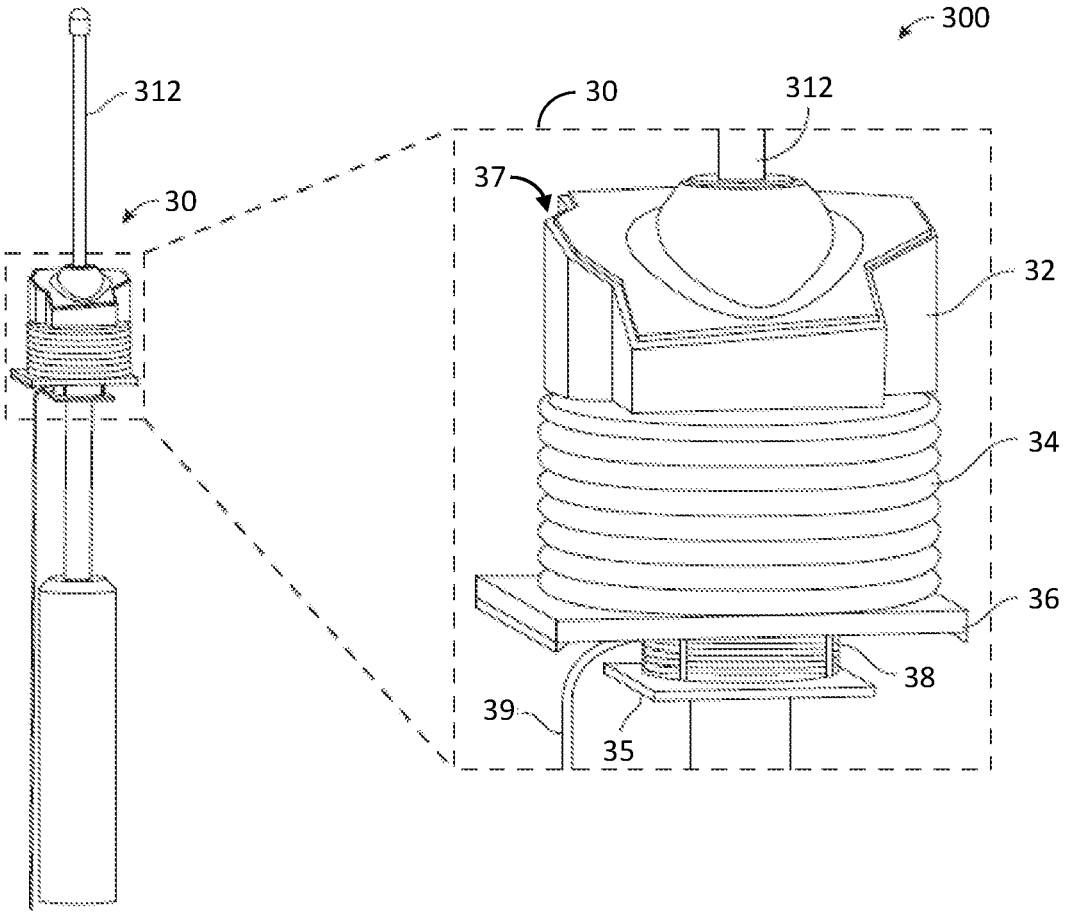
FIG. 3 depicts a perspective and exploded view of a sail-mounted inflatable deployable mast fairing assembly according to a first embodiment of the present invention.
Figure 4:
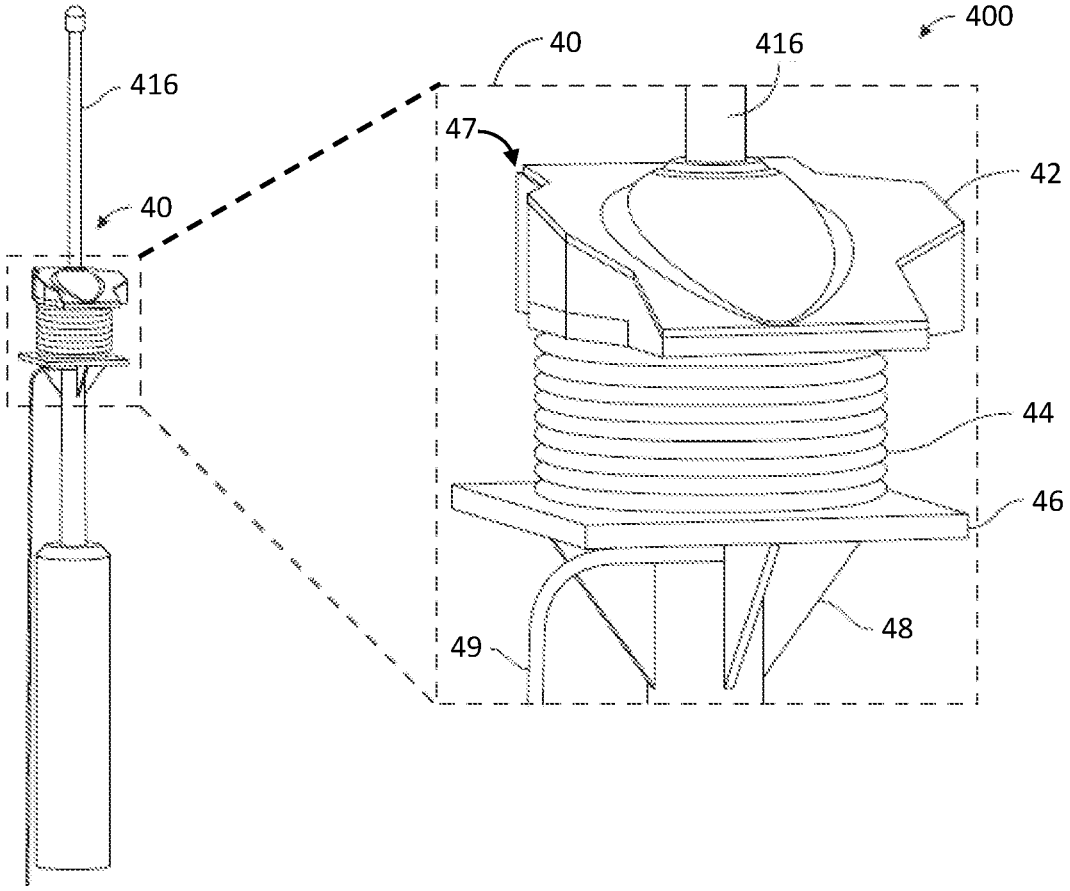
FIG. 4 depicts a perspective and exploded view of a mast-mounted inflatable deployable mast fairing assembly according to a second embodiment of the present invention.

Referring to FIG. 3 and FIG. 4, the inflatable and deployable mast fairing assemblies have three major sections: a hydrodynamic fairing (a rigid structure, an inflatable structure, or a rigid/inflatable hybrid structure), an inflatable/collapsible actuator and a rigid foundation. FIG. 3 depicts a mast fairing assembly implemented with a sail-mounted foundation and FIG. 4 depicts an alternative inflatable deployable mast fairing assembly implemented with a mast-mounted foundation.

The schematic 300 of FIG. 3 depicts a sail-mounted inflatable deployable mast fairing (IDMF) assembly 30 with a hydrodynamic fairing 32, an inflatable soft actuator 34 for on-demand deployment, a sail-mounted foundation 36 and an inflatable soft actuator 38 for on-demand retraction. The fairing 32 may be a rigid material having a perimeter shape that fits a sail bay aperture and presents a substantially central aperture through which an upper portion of a mast 312 protrudes and retracts. The mast 312 moves independently of the sail-mounted foundation 36.

The schematic 400 of FIG. 4 depicts a mast-mounted inflatable deployable mast fairing (IDMF) assembly 40 including a hydrodynamic fairing 42, an inflatable soft actuator 44, a mast-mounted foundation 46 and a fixed foundation support 48. Because the mast-mounted foundation 46 is carried by the mast 416 by using the affixed foundation supports 48; movement of the mast causes similar movement of the IDMF assembly 40.

The hydrodynamic fairing 42 may be rigid material having a perimeter shape that fits to a contour of a sail bay aperture with an aperture through which an upper portion of the mast 416 may protrude. The hydrodynamic fairing 42 can deploy along the mast 416 and away from the mast-mounted foundation 46 and can retract along the mast toward the mast-mounted foundation.

Each of the inflatable soft actuators 34, 38 and 44 are constructed of vertically stacked cylindrical arches that have internal bladders for fluid retention. The cylindrical arches are secured together by webbing straps (not shown). The uppermost and bottommost cylindrical arches of each inflatable soft actuator 34, 38 and 44 includes a mechanical interface to mate with a respective profile of other assembly components (hydrodynamic fairings 32, 42; the sail-mounted foundation 36; a counter flange 35; and the mast-mounted foundation 46).

Adding fluid to an interior (internal bladders) of either of the deploying inflatable soft actuators 34, 44 elongates the inflatable soft actuator through inflation and deploys the respective hydrodynamic fairing 32, 42. Conversely, expelling fluid from the interior of either of the deploying inflatable soft actuators 34, 44 decreases the height of the inflatable soft actuators through deflation and retracts the respective hydrodynamic fairing 32, 42.

In the sail-mounted IDMF assembly 30, adding fluid to an interior of the soft actuator 38 applies downward force (with respect to the sail-mounted foundation 36) onto the counter flange 35. This downward force contributes to retraction of the hydrodynamic fairing 32 through deflation of the inflatable soft actuator 34 by inducing expulsion of fluid from the actuator.

The inflatable fairings 32, 42 and the soft actuators 34, 38 and 44 are pressurized using a manifold 39, 49 connected to the onboard air and water (preferable) supply sources of the host vessel. The manifold 39, 49 sequences and regulates the supply of air and water to the fairings 32, 42 and the soft actuators 34, 38 and 44 and is configured with pressure relief and fill valves to prevent over-inflation and under-inflation.

Pressurization with water provides mass for ballasting to minimize deflections, increase the stability of the IDMF assembly 30 and eliminate risk from implosion. Once inflated to proper operating pressure levels, the inflated components become rigid and the IDMF assembly 30 is deployed with sufficient stiffness to resist sea-state induced motions and wave slap loadings.

In the embodiments described above, the fairing component 32, 42 is shape-configured to match the outer boundaries of the aperture in the sail cap and can be constructed of an inflatable, hybrid rigid/soft inflatable or a rigid structure. Each fairing 32, 42 includes a tapered and/or locking outer perimeter 37, 47 that prevents the fairing from ejecting through the sail cap aperture and has a central inner opening (see aperture 82 of FIG. 8) that allows the mast to pass through during deployment and retraction.

As described hereinbelow, the inflatable soft actuators secure the fairings in their deployed position at the sail cap. These actuators are pressurized with water (or potable water) to controllably drive the fairing into position and to prevent the fairing from displacing in a downward vertical direction when the mast is in operation and the sail is exposed to hydrostatic and hydrodynamic pressures.

Referring to FIGS. 5 and 6, the IDMF assemblies 30, 40 are shown with masts as examples of deployed hardware systems. The figures illustrate deployed configurations of the sample masts, while FIG. 7 illustrates stowed configurations of the sample masts. Regardless of the sail class and closure mechanisms; the fairing concepts can conform to the apertures for a variety of externally deployed and internally stowed sail hardware systems.

The exploded view 600 of FIG. 6 depicts the sail-mounted foundation 36, to the inner walls of a sail bay 502 and below a sail cap 712, 714 of FIG. 7. Opposite sides of the sail-mounted foundation 36 provide a fixed platform for each of two opposing soft actuators: the deployment inflatable soft actuator 34 positioned vertically above the foundation to deploy the hydrodynamic fairing 32, and the retraction inflatable soft actuator 38 positioned vertically below the foundation to stow the hydrodynamic fairing.

Figure 8:
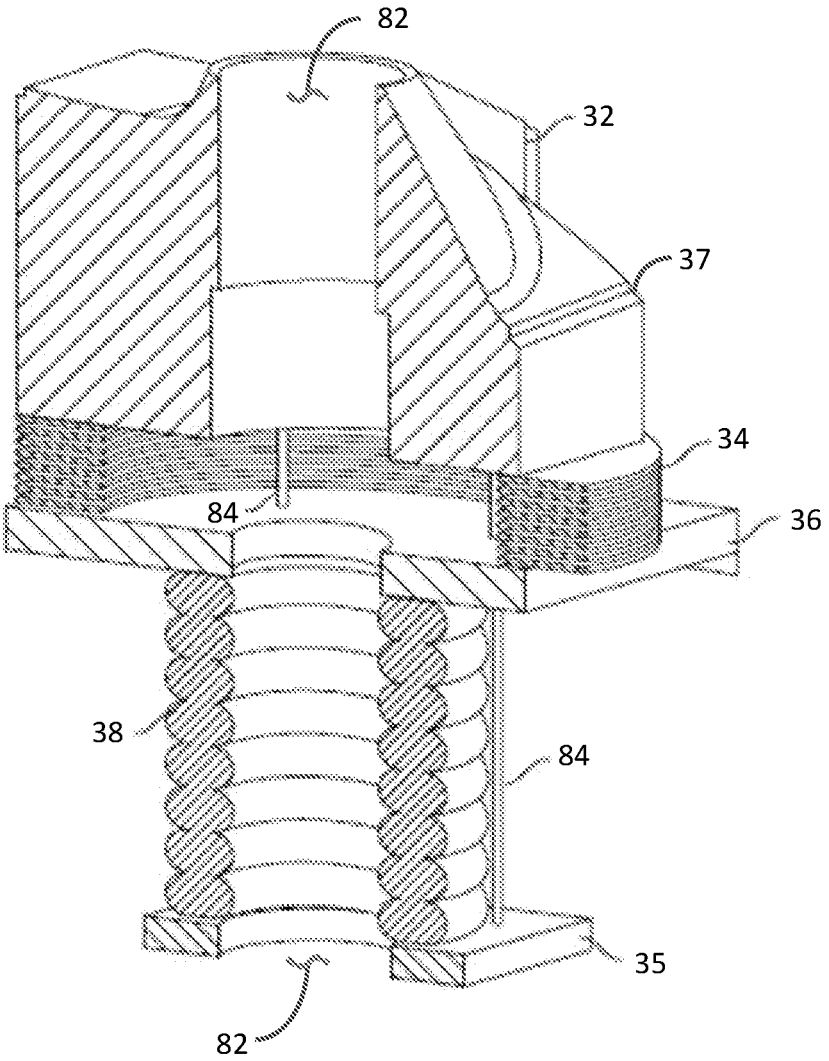
FIG. 8 depicts a cross-section view of the sail-mounted inflatable deployable mast fairing assembly of FIG. 3 with the view taken along reference lines 8-8 of FIG. 7.

The soft actuators 34, 38 provide opposing vertical motions as applied to the fairing 32 with only one of the actuators pressurized at any given time. As shown in FIG. 6, the upper actuator 34 is pressurized to push the fairing 32 into position at the surface of the sail cap; while and as shown in FIG. 8, the lower actuator 38 is pressurized to retract the upper actuator and to pull the fairing below the sail cap 712.

The actuators 34, 38 are structurally connected using connecting members 84 (e.g., membranes, cordage, rods) secured from a first surface of the upper actuator 34 to a second surface of the lower actuator 38 so that when the upper actuator is deployed and the pressure is released in the lower actuator; the fairing 32 is raised into deployed position. In an opposing operation, the lower actuator 38 is pressurized and the pressure in the upper actuator is released; thereby, causing the fairing to retract below the sail cap for stowage.

During deployment, the mast 312 is raised through the sail bay 502 and slides through the fairing assembly central inner core (which includes not only the aperture 82 in the fairing 32, but also mast-receiving, coaxial voids in the actuator 34, the sail-mounted foundation 36, the actuator 38, and the counter flange 35). Through this central inner core, the mast 312 enters the flow stream external to the host sail system 100. The fairing 32 (if equipped with an inflatable chamber) and the upper soft actuator 34 are then fully pressurized and secured in place of the sail cap 712.

The view 500 of FIG. 5 and the view 600 of FIG. 6 also depict the mast-mounted foundation 46 of the IDMF assembly 40 rigidly connected to the mast 416 at a position below the top of the mast 416. During deployment, the mast 416 and hydrodynamic fairing 42 are vertically raised together as a single unit within the sail bay 504. Once the mast 416 is secured in an operational position, the fairing 42 (if equipped with an inflatable chamber) and/or the soft actuator 44 are either partially or fully pressurized to maintain and control positioning of the fairing within the aperture.

The inflatable components described hereinabove are preferably constructed of high performance fabrics such as liquid crystal polymer, dimensionally stable polyester, polyethylene napthalate, ultra-high molecular weight polyethylenes, aramid, and others, that are woven, braided, knitted and/or constructed with other textile processing methods and fiber placement architectures known to those skilled in the art. Additional structural reinforcement members can achieve increased tensile and shear stiffnesses and strengths, increased damage tolerance, enhanced shape control for hydrostatic and hydrodynamic loadings and increased inflation pressure capacities.

The soft structures considered for use in the designs described hereinabove may include, but are not limited to, control volumes constructed of inflated membranes, three-dimensional woven preforms, flexible bladders, coated fabrics, fabrics with integrated electrical conductors, hybrid (soft/rigid) material systems, and/or hard goods-to-soft goods connections. Hybrid inflatable fairings may include inflatable elements with semi- or fully-rigid reinforcements serving as deployment shaping controls, and/or abrasion resistant contact surfaces. The pressurization media for inflatable components of the present invention may be limited to water, potable water or other liquid to eliminate an implosion risk.

The IDMF designs leverage state-of-the-art inflatable structures, materials technologies, and pre-tensioning (load stiffening) methods derived from demanding applications that have demonstrated successful performance against severe loading environments. Fundamental components of these demanding applications are high performance fibers and continuous woven or braided three-dimensional fabric preforms.

Upon full inflation, the hydrodynamic fairings fully conform to the surfaces of the mast and sail cap apertures. The contact pressure exerted on the sail equipment is limited to the inflation pressure in the inflatable or hybrid rigid/inflatable fairing. Damping performance is increased through use of inflatable components in contrast to traditional rigid structures because the membrane constructions do not transmit structural vibrations arising from compressive and bending strain energies.

The soft actuators eliminate the need for complex mechanical or electro-mechanical drive systems. An onboard water pump provides water for internal pressurization of the fairings (if equipped with an inflatable chamber) and soft actuators through a manifolded connection. A pressure relief valve is incorporated in the manifold to regulate and prevent excess inflation pressure and to release inflation pressure when the system is returned to a non-operational state and stowed inside the sail bay.

Advantages of the present invention include a structurally robust, on-demand deployable and inflatable fairing assembly for temporary closure of sail bay apertures. Flow noise is reduced through the closing of apertures formed along the sail cap surface when mast equipment and similar hardware systems are deployed from the sail and into the external flow stream. Flow noise is also reduced through the increased damping performance afforded by the use of soft material membranes.

The present invention increases the hydrodynamic performance of sail equipment projecting outward from the sail to the flow stream by using faired structural shapes formed with inflatable, rigid and hybrid inflatable/rigid fairings; water-inflation as needed for structural rigidity to deploy and secure the fairing at the sail bay aperture.

The present invention also conforms to the mast or other sail equipment projecting outward from the sail to the flow stream and provides actuation forces sufficient to prevent motion of the deployed fairing with respect to the sail cap when subject to hydrostatic and hydrodynamic pressures. The present invention also provides self-stowage when the mast equipment is non-operational and stowed inside the sail bay.

The invention further provides deployment and retrieval using inflation pressure and does not require mechanical or electro-mechanical drive units. The invention also provides a mounting foundation either attached to the sail bay or directly to the mast (or other hardware system).

Variations and alternatives of the components, materials, geometries, manufacturing, and structural design are considered within the scope of the present invention. Both rigid and hybrid soft/rigid versions of the fairing are possible variations of construction.

Regions in the inflatable fairings and inflatable soft actuators that require localized strengthening such as valve insertion points, manifold connections, and joints can be reinforced with doublers including fabric layers or thin films that are stitched, radio frequency welded or attached using methods known to those skilled in the art.

The use of air (or other gas) or fluid other than water are considered as possible alternatives for the pressurization media especially when subject to freezing temperatures and below. However, as previously stated, air or gas pressurization of the inflatable fairing and soft actuators can result in implosion. The fairings and inflatable soft actuators can include embedded electronics for structural health monitoring and to potentially host additional antennas and sensors.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. An inflatable deployable mast fairing assembly for closing an aperture formed between a deployable hardware system and a sail bay opening, said assembly comprising:

a rigid foundation;

a hydrodynamic fairing characterized by a perimeter shape fitted to a contour of the aperture and by a void configured to fittedly receive a portion of the deployable hardware system; and a first soft actuator having a cylindrical bladdered membrane mechanically mounted at a bottom end to said rigid foundation and at a top end to said hydrodynamic fairing, and configured to coaxially elongate to the deployable hardware system upon fluid pressurization and to fittedly position said hydrodynamic fairing in the aperture formed between the deployable hardware system and the sail bay opening.

2. The inflatable deployable mast fairing assembly in accordance with claim 1, wherein said rigid foundation is mast-mounted.

3. The inflatable deployable mast fairing assembly in accordance with claim 1, wherein said rigid foundation further comprises a sail-mounted foundation;

a counter flange positioned opposite said sail-mounted foundation with said soft actuator therebetween;

at least one connecting rod configured to mechanically attach said counter flange to said hydrodynamic fairing; and a second soft actuator comprising a second substantially cylindrical bladdered membrane mechanically mounted at a first end to said sail-mounted foundation opposite said bottom end of said soft actuator and at a second end to said counter flange, and configured to elongate coaxial to the deployable hardware system upon a second fluid pressurization and to retract said hydrodynamic fairing from the aperture.

4. The inflatable deployable mast fairing assembly in accordance with claim 3, wherein said first soft actuator, said sail-mounted foundation, said second soft actuator, and said counter flange each comprise a void positioned coaxial with the aperture of said hydrodynamic fairing, defining a central inner core configured to axially receive the deployable hardware system.

5. The inflatable deployable mast fairing assembly in accordance with claim 1, wherein said first soft actuator further comprises a plurality of vertically stacked cylindrical arches secured with a plurality of webbing straps.

6. The inflatable deployable mast fairing assembly in accordance with claim 5, wherein said plurality of vertically stacked cylindrical arches further comprise a circular woven fabric characterized by internal bladders for fluid retention.

7. The inflatable deployable mast fairing assembly in accordance with claim 1, further comprising a manifold operable to supply the fluid pressurization.

8. The inflatable deployable mast fairing assembly in accordance with claim 1, wherein said hydrodynamic fairing further comprises an inflatable chamber configured upon fluid pressurization to fittedly position said hydrodynamic fairing in the aperture.

9. A method of closing an aperture formed between a deployable hardware system and a sail bay opening; said method comprising the steps of:

fittedly positioning a hydrodynamic fairing in the aperture by elongating, upon a first fluid pressurization, a first soft actuator coaxial to the deployable hardware system; and fittedly receiving into a substantially central hole of the hydrodynamic fairing, a portion of the deployable hardware system.

10. The method in accordance with claim 9, wherein said method further comprises the steps of:

retracting the hydrodynamic fairing from the aperture by elongating, upon a second fluid pressurization, the second soft actuator coaxial to the deployable hardware system; and axially receiving into the central inner core, the deployable hardware system.

* * * * *